US010415565B2

(12) United States Patent
Haugaard

(10) Patent No.: US 10,415,565 B2
(45) Date of Patent: Sep. 17, 2019

(54) VANE CELL MACHINE

(71) Applicant: Danfoss A/S, Nordborg (DK)

(72) Inventor: Erik Haugaard, Grasten (DK)

(73) Assignee: Danfoss A/S, Nordborg (DK)

( * ) Notice: Subject to any disclaimer, the term of this patent is extended or adjusted under 35 U.S.C. 154(b) by 579 days.

(21) Appl. No.: 15/017,810

(22) Filed: Feb. 8, 2016

(65) Prior Publication Data

US 2016/0230757 A1 Aug. 11, 2016

(30) Foreign Application Priority Data

Feb. 11, 2015 (EP) ..... 15154613

(51) Int. Cl.

| | |
|---|---|
| ***F01C 21/08*** | (2006.01) |
| ***F04C 15/00*** | (2006.01) |
| ***F04C 2/34*** | (2006.01) |
| ***F01C 21/10*** | (2006.01) |
| ***F04C 2/344*** | (2006.01) |

(52) U.S. Cl.

CPC ..... *F04C 15/0023* (2013.01); *F01C 21/0809* (2013.01); *F01C 21/108* (2013.01); *F04C 2/344* (2013.01)

(58) Field of Classification Search

CPC .... F01C 1/3448; F01C 19/08; F01C 21/0809; F01C 21/106; F01C 21/108; F04C 15/0023; F04C 2/344; F04C 2/3448

USPC ..... 418/106, 23, 24, 82, 229

See application file for complete search history.

(56) References Cited

U.S. PATENT DOCUMENTS

| | | | | |
|---|---|---|---|---|
| 4,913,629 | A * | 4/1990 | Gilfillan | F04C 2/084 417/309 |
| 9,617,994 | B2 * | 4/2017 | Walters | F04C 2/3448 |
| 2013/0108498 | A1 * | 5/2013 | Petersen | F04C 15/0023 418/131 |
| 2013/0251571 | A1 | 9/2013 | Iijima | |

FOREIGN PATENT DOCUMENTS

| | | | |
|---|---|---|---|
| CN | 1210936 | A | 3/1999 |
| CN | 203906271 | U | 10/2014 |
| DE | 10 2011 116 858 | A1 | 4/2013 |
| DE | 10 2011 116 869 | A1 | 4/2013 |
| EP | 2690252 | A1 | 1/2014 |

* cited by examiner

*Primary Examiner* — Mary Davis
*Assistant Examiner* — Dapinder Singh
(74) *Attorney, Agent, or Firm* — McCormick, Paulding & Huber LLP

(57) ABSTRACT

A vane cell machine is provided comprising a housing having a stator bore with an outer limitation formed by a circumferential wall and two axial end faces (5), a rotor mounted rotatably in said stator bore, a plurality of vanes moveable in radial direction relative to said rotor and sliding along said circumferential wall, and sealing means (12) at least at one of said end faces (5), said sealing means (12) acting on said rotor in axial direction. Such a vane cell machine should have a simple construction. To this end said end face (5) is formed at an end plate (11) of said housing wherein said end plate (11) comprises a recess in which said sealing means (12) are rotated.

18 Claims, 1 Drawing Sheet

VANE CELL MACHINE

CROSS REFERENCE TO RELATED APPLICATION

Applicant hereby claims foreign priority benefits under U.S.C. § 119 from European Patent Application No. EP15154613.2 filed on Feb. 11, 2015, the content of which is incorporated by reference herein.

TECHNICAL FIELD

The present invention relates to a vane cell machine comprising a housing having a stator bore with an outer limitation formed by a circumferential wall and two axial end faces, a rotor mounted rotatably in said stator bore, a plurality of vanes moveable in radial direction relative to said rotor and sliding along said circumferential wall, and sealing means at least at one of said end faces, said sealing means acting on said rotor in axial direction.

Such a vane cell machine is known, for example, from DE 10 2011 116 869 A1.

BACKGROUND

In such a vane cell machine the rotor is located with its rotational axis having a distance to a middle axis of the stator bore. Pressure chambers are formed between the rotor, the vanes and the circumferential wall of the stator bore, said pressure chambers being closed axially by said end faces. When the rotor rotates, the vanes are moved radially into and out of the rotor and the pressure chambers increase and decrease their volume. When such a vane cell machine is used as pump, during the increasing phase of the pump chambers fluid is sucked into the stator bore and during the decreasing phase of the pump chambers the fluid is pushed out of the machine. When the vane cell machine is used as motor, inputted fluid under pressure tends to increase the volume of the pump chambers thereby causing a rotation of the rotor.

In any case it is necessary to have sealing means acting on the rotor so that there is no leakage out of the housing when the rotor rotates.

In the vane cell machine mentioned above the sealing means are formed by a sealing ring which is positioned radially inside an outer ring serving as wear element. This makes the construction complicated.

SUMMARY

The object underlying the invention is to have a simple construction of a vane cell machine.

This object is solved with a vane cell machine as described at the outset in that said end face is formed at an end plate of said housing wherein said end plate comprises a recess in which said sealing means are located.

It is no longer necessary to use two separate plates at the axial end of the housing, but it is possible to use an end plate made of one piece which is only to be machined to accommodate the sealing means. When the sealing means is located within the recess it is stabilized against a radial movement. Mounting is simple because only two parts have to be handled. An end plate made of a single piece is stiffer than a combination of two or more plates and can therefore withstand higher pressures or it can be made thinner.

In a preferred embodiment said recess is limited at its radially inner end by a ring-shaped wall which is integral with said end plate. The recess is formed as a kind of groove within said end plate.

Preferably said sealing means protrude out of said recess in a direction towards said rotor. Such a protrusion can be made rather small. It is only necessary that the sealing means contact said rotor so that the rotor does not contact the radially outer part of the end plate.

Preferably said sealing means comprise a sealing ring mounted on an insert part inserted into said recess. The sealing ring, for example an O-ring, is used for the sealing function. The insert part is used for the supporting function. When these two functions are decoupled, each function can be realized with simple means and a good effect.

In a preferred embodiment force generating means are provided to press said sealing means against said rotor. Such force generating means can be used to produce a predefined force. This force is chosen so that the friction between the sealing element and the rotor does not exceed a predefined value on the one hand and on the other hand the force is high enough to secure sufficient sealing.

Preferably said force generating means comprise spring means and/or hydraulic pressure. In other words, spring means alone or hydraulic pressure alone can be used as well as a combination of spring means and hydraulic pressure. The hydraulic pressure can be generated during the operation of the vane cell machine.

Preferably said insert part comprises a radially outer contour deviating from a cylinder form. This is a simple way to secure the insert part against rotation.

In an alternative or additional solution said insert part and said end plate have a common rotation preventing element. Such a rotating preventing element can be in form of a pin protruding into the end plate and into the sealing element. This rotation prevention arrangement can be realized in a cost effective manner.

Preferably said end plate comprises a thickness at least three times a thickness of said insert part. The recess does not weaken the end plate too much.

Preferably each of said vanes comprises a radially inner edge and a radially outer edge, both edges being rounded. As mentioned above, the vanes slide along the circumferential wall of the stator bore. During one revolution of the rotor the inclination of each vane relative to the circumferential wall of the stator bore varies slightly due to the eccentricity of the rotor axis to the center axis of the stator bore. Therefore, the rounding of the outer edge is beneficial. On the other hand, the vanes can come in contact with the sealing element, for example with the insert part of the sealing element, and they can tilt forth and back when they are in contact with the sealing element. It is therefore beneficial to round the radially inner edge as well.

Preferably both edges are rounded with the same radius. This simplifies machining of the edges of the vane.

In a particular preferred embodiment both edges follow a common circle line. Both edges can be machined in a common machining process.

BRIEF DESCRIPTION OF THE DRAWINGS

A preferred example of the invention will now be described in more detail with reference to the drawing, wherein.

DETAILED DESCRIPTION

Figure 3:
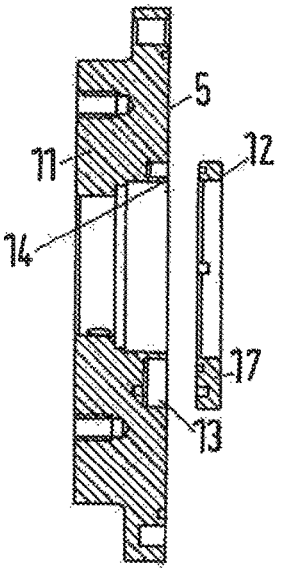
FIG. 3 is a section III-II of FIG. 2

A vane cell machine 1 comprises a housing 2 having a stator bore 3 which is limited to the outside by a circumferential wall 4 and in axial direction by two end faces 5 one of which is shown in FIG. 3. A rotor 6 is located within said stator bore 3. The rotor 6 carries a number of vanes 7. Each vane 7 is moveable in radial direction with respect to the rotor 6. To this end the rotor 6 comprises a core 8 and, for each vane 7, a protrusion 9 in which a slit 10 is formed. The vane 7 is slidably positioned within said slit 10.

Figure 1:
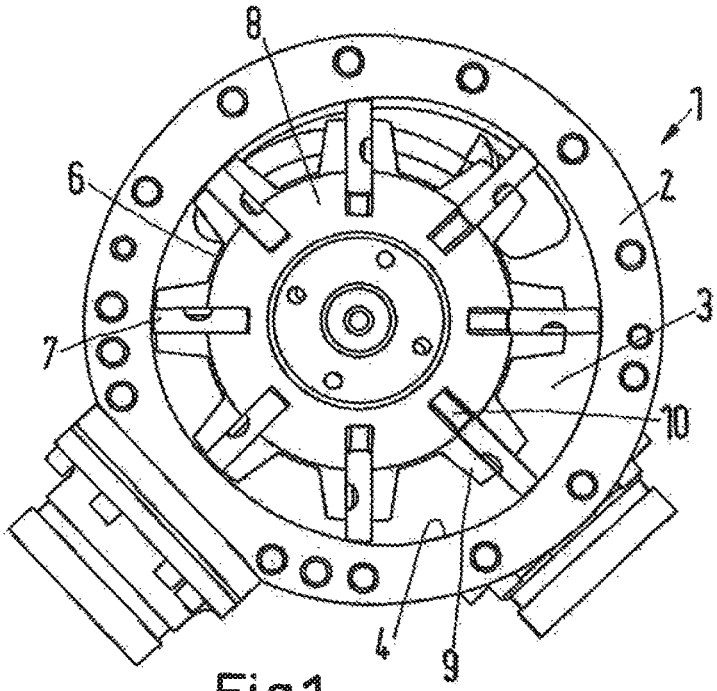
FIG. 1 is a schematic illustration of a vane cell machine with a housing and a rotor.

As can be seen in FIG. 1, the rotor 6 is positioned eccentrically within the stator bore 3. Two adjacent vanes 7 together with the rotor 6 and the circumferential wall 4 limit a pressure chamber. It can be seen that during rotation of the rotor 6 the volume of each pressure chamber increases in a first section of one revolution of the rotor 6 and decreases in another section of the revolution.

As can be seen in FIG. 3, the end face 5 is located at an axially inner side of an end plate 11. This end plate 11 is a single piece, i.e. it does not consist of two or more layers or partial plates.

Sealing means 12 are provided, said sealing means 12 acting on rotor 6 in axial direction securing against a leaking of fluid in the pressure chamber out of the machine 1 during rotation of the rotor 6.

In order to accommodate the sealing means 7, the end plate 11 comprises a recess 13. Recess 13 is limited on its radially inner side by a ring-shaped wall 14 which is made in one piece with end plate 11. Recess 13, therefore, can be considered as groove.

Sealing means 12 comprise a sealing ring 16, for example an O-ring, mounted on an insert part 17 which can be considered as carrier for the sealing ring 16. In the mounted state the insert part 17 is accommodated within recess 13 so that only the sealing ring 16 protrudes a bit in a direction towards the rotor 6.

Figure 2:
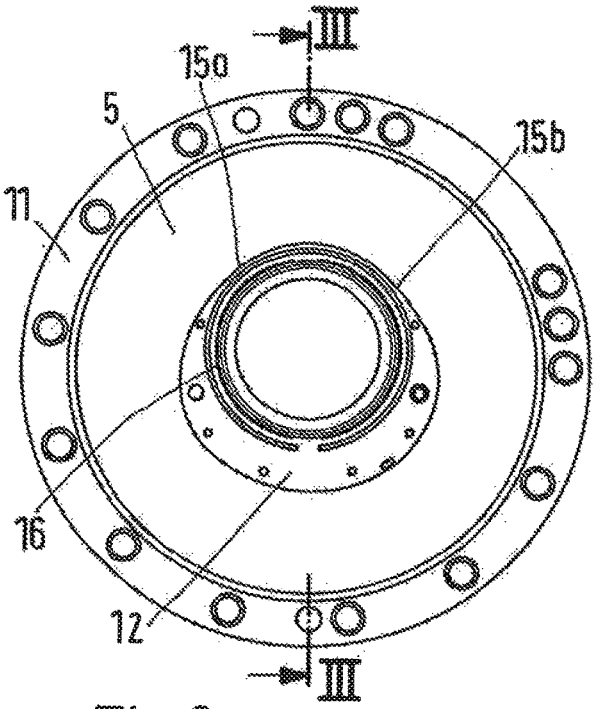
FIG. 2 is a view of an end plate seen from the rotor.

Sealing means 12 and recess 13 have the same outer form. However, as can be seen in FIG. 2, this outer form can deviate from a circle line. The sealing means 12 and the recess 13 have along its circumference two sections 15*a*, 15*b* in which the local radius of the insert part 17 is smaller than the radius of a circle line enclosing the sealing means 12. Such a form secures sealing means 12 against rotation in end plate 11.

It is, however, possible to use sealing means 12 in form of a cylinder and to secure the sealing means 12 in another way against rotation, e.g. by means of a pin inserted into the end plate 11 and into sealing means 12.

The end plate 11 has a thickness which is preferably at least three times a thickness of the insert part 17. Therefore, the end plate 11 is sufficiently stable to withstand high pressures in the pressure chambers.

During one revolution of the rotor 6 each vane 7 tilts once in direction of rotation and once in the opposite direction. Each vane 7 comprises a radially inner edge 18 and a radially outer edge 19. The radially outer edge 19 contacts permanently the circumferential wall 4 and is therefore rounded. The radially inner edge 18 is rounded as well to avoid wear of this radially inner edge 18 since in some sections of one revolution the radially inner edge 18 of each vane 7 can have contact with the sealing means 12.

Figure 4:
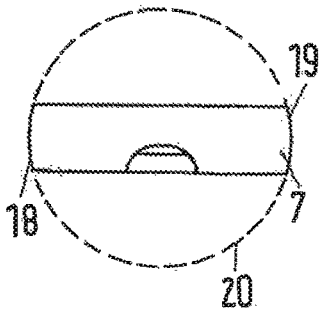
FIG. 4 is a sectional view of a vane.

As can be seen in FIG. 4, both edges 18, 19 are rounded with the same radius. This can be achieved by machining the vane 7 so that both edges follow a common circle line 20.

The recess 13 can be provided with force generating means acting between the end plate 11 and the insert 17. One possible form of force generating means are spring means. Such spring means press the sealing element 12 against the rotor 6 in order to achieve a sufficient sealing against leakages.

Another way for generating the required forces is to guide hydraulic fluid under pressure into a chamber formed by the recess and the insert 17 so that this hydraulic fluid can act between the end plate 11 and the insert 17 thereby urging the sealing means 12 against the rotor.

In a region in which the pressure chambers have the smallest volume and the pressure of the fluid therefore is the highest, the area of the insert 17 on which the hydraulic pressure acts is the highest as well. It is therefore possible to achieve the highest sealing forces in the region in which the highest fluid pressures exist.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A vane cell machine comprising a housing having a stator bore with an outer limitation formed by a circumferential wall and two axial end faces, a rotor mounted rotatably in said stator bore, a plurality of vanes movable in radial direction relative to said rotor and sliding along said circumferential wall, and sealing means at least at one of said end faces, said sealing means acting on said rotor in axial direction, wherein said end face is formed at an end plate of said housing, wherein said end plate comprises a recess in which said sealing means are located, wherein said recess is limited at its radially inner end by a ring shaped wall which is integral with said end plate, wherein said sealing means protrude out of said recess in a direction towards said rotor, wherein said sealing means comprise a sealing ring mounted on an insert part inserted into said recess such that said insert part rests against a surface of said end plate that faces said rotor in said axial direction, and wherein said sealing ring is arranged between said insert part and said rotor.

2. The vane cell machine according to claim 1, wherein a force generating means is provided to press said sealing means against said stator.

3. The vane cell machine according to claim 2, wherein said force generating means comprise spring means and/or hydraulic pressure.

4. The vane cell machine according to claim 2, wherein said insert part comprises a radially outer contour deviating from a cylinder form.

5. The vane cell machine according to claim 1, wherein said insert part comprises a radially outer contour deviating from a cylinder form.

6. The vane cell machine according to claim 1, wherein said insert part and said end plate have a common rotation preventing element.

7. The vane cell machine according to claim 1, wherein said end plate comprises a thickness at least three times a thickness of said insert part.

8. The vane cell machine according claim 1, wherein each of said vanes comprises a radially inner edge and a radially outer edge, both edges being rounded.

9. The vane cell machine according to claim 8, wherein both edges are rounded with the same radius.

10. The vane cell machine according to claim 9, wherein both edges follow a common circle line.

11. The vane cell machine according to claim 1, wherein the sealing means protrudes from the insert part toward the rotor.

12. The vane cell machine according to claim 1, wherein the sealing ring is mounted on the insert part such that the insert part is a carrier of the sealing ring.

13. The vane cell machine according to claim 1, wherein said end plate extends radially further than said plurality of vanes.

14. A vane cell machine comprising:

a housing having a stator bore with an outer limitation formed by a circumferential wall and two axial end faces;

a rotor mounted rotatably in the stator bore;

a plurality of vanes movable in a radial direction relative to the rotor and sliding along the circumferential wall; and a sealing means comprising a sealing ring located at one of the two axial end faces;

wherein the sealing ring acts on the rotor in an axial direction;

wherein the end face having the sealing ring is formed at an end plate of the housing;

wherein the end plate comprises a recess in which the sealing ring is located;

wherein the sealing ring is mounted on an insert part inserted into the recess such that said insert part rests against a surface of said end plate that faces said rotor in said axial direction; and wherein the sealing ring protrudes out of the recess from the insert part in a direction towards the rotor.

15. The vane cell machine according to claim 14, wherein a force generating means is provided to press said sealing means against said stator.

16. The vane cell machine according to claim 15, wherein said force generating means comprise spring means and/or hydraulic pressure.

17. The vane cell machine according to claim 14, wherein said sealing ring protrudes towards the rotor in said axial direction.

18. The vane cell machine according to claim 14, wherein said end plate extends radially further than said plurality of vanes.

* * * * *